United States Patent [19]

Lesh

[11] Patent Number: 4,571,744

[45] Date of Patent: Feb. 25, 1986

[54] OUTFIT OF INSULATED CLOTHING FOR INFANTS

[76] Inventor: Jerry H. Lesh, 8015 Urbann Rd., Manassas, Va. 22110

[21] Appl. No.: 603,298

[22] Filed: Apr. 24, 1984

[51] Int. Cl.[4] ..... A41B 9/00
[52] U.S. Cl. ..... 2/111
[58] Field of Search ..... 2/81, 111, 7, 201, 202

[56] References Cited

U.S. PATENT DOCUMENTS

| | | | |
|---|---|---|---|
| 2,627,072 | 2/1953 | Frommelt et al. | 2/97 |
| 3,739,399 | 6/1973 | Sheahon | 2/69.5 |
| 3,750,202 | 8/1973 | Merikallio | 2/69.5 |
| 4,083,064 | 4/1978 | Schneider | 2/69.5 |
| 4,420,521 | 12/1983 | Carr | 2/69.5 |

*Primary Examiner*—Doris L. Troutman
*Attorney, Agent, or Firm*—Littlepage & Webner

[57] ABSTRACT

A thermally insulated wrap-around blanket and a thermally insulated cap are used to maintain infant body temperature in the post-delivery period.

4 Claims, 4 Drawing Figures

OUTFIT OF INSULATED CLOTHING FOR INFANTS

BACKGROUND OF THE INVENTION

Hitherto little attention has been paid to methods of maintaining the body temperature of newborn infants, particularly in the immediate post-delivery period. The problem is especially severe for premature babies and other babies having low birth weight. A newborn infant traditionally has been swaddled in a simple blanket and transported from the delivery room to the hospital nursery, with little emphasis placed on retention of natural body heat.

Furthermore, in recent years doctors have determined that bonding of newborn babies to their parents is very important in their development, and that it is particularly important that bonding commence as soon after birth as possible. Parent-infant bonding dictates close parent-infant contact immediately following birth, and this delays the transportation of the baby to the nursery. Since many hospital nurseries are located a considerable distance from the delivery facilities, in some cases even on other floors of the hospital, substantial heat loss from the infant is predictable, with, in some cases, harmful results.

OBJECTS OF THE INVENTION

It is an object of this invention to provide an outfit of thermally insulating clothing for maintaining body temperature in infants, particularly in newborn babies.

It is another object of this invention to provide an outfit of thermally insulated clothing for newborn infants in which the insulation is provided by a layer of thermally insulating material, preferably a layer of reflecting foil, which reflects the escaping body heat of the infant back toward the infant's body.

It is a further object of this invention to promote parent-infant bonding by preserving the infant's body heat thus more safely permitting parents and infants to spend time together in the immediate post-delivery period.

It is also an object of the invention to prevent loss of body heat in infants particularly in premature babies and other babies having a low birth weight.

These and other objects will be apparent from the specification and claims and by reference to the figures in which like numerals denote like parts, where:

Figure 1:
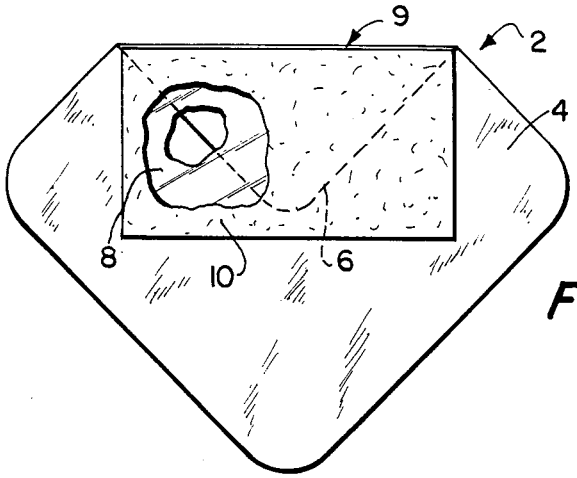
FIG. 1 is a plan of the inside of the thermally insulated blanket.
Figure 2:
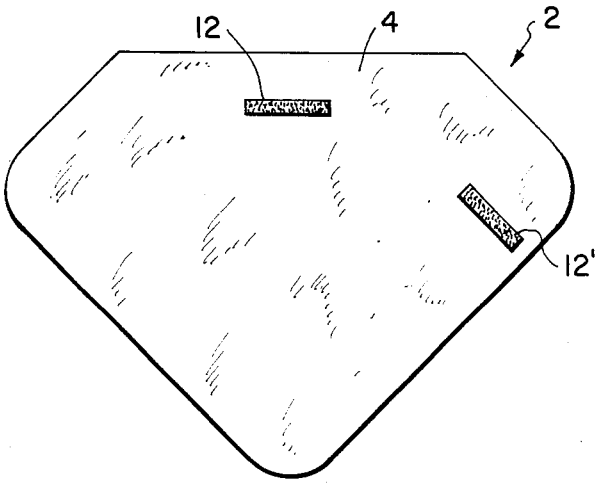
FIG. 2 is a plan of the outside of the thermally insulated blanket.

Referring to FIG. 1, the thermally insulated blanket 2 is made from a square sheet of fabric 4 having an inner side and an outer side, and having one corner 6 folded inwards to form a pentagonal shape. A rectangular sheet of thermally insulating material 8, having at least one reflecting surface, is laid on top of the inner side of fabric 4 with a long edge 9 of the thermally insulating material adjacent and parallel to the fold of sheet 4 with the at least one reflecting surface facing away from the inner side of the sheet of fabric 4. A layer of lining material 10 of approximately the same size as the sheet of thermally insulating material 8 is laid on top of the at least one reflecting surface of the thermally insulating material, completely covering it. The lining layer 10 and the insulating layer 8 are stitched around their perimeters securing them to the inside of fabric 4. On the outer side of fabric 4, two lengths of adhesive fabric tape, for example "VELCRO" tape, are fastened, as shown in FIG. 2, positioned so that when the thermally insulated blanket 2 is wrapped around the baby, the two pieces of tape mate together, securing the blanket snugly around the baby.

Figure 3:
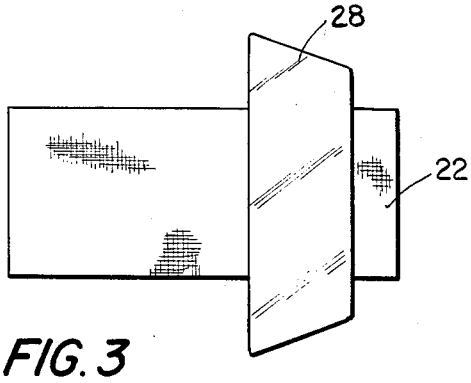
FIG. 3 is a plan of the fabric laid out for manufacture of the cap.
Figure 4:
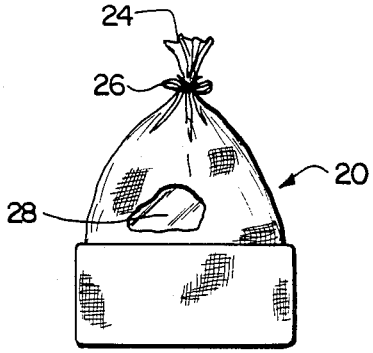
FIG. 4 is a side view of the completed thermally insulated cap.

Referring to FIGS. 3 and 4, cap 20 is formed from a tube of fabric 22 which is doubled by folding to make a tube of double fabric having an inside layer and an outside layer, and then gathered together at the open unfolded end 24 with a ribbon 26 or other securing device. Before the tube 22 is secured by ribbon 26, a sheet of thermally insulating material 28, having at least one reflecting surface, is inserted between the two layers of fabric with the at least one reflecting surface facing the inner layer of the cap, to reflect heat back from the baby's head toward the body. In the process of securing cap 20 with ribbon 26, sheet 28 is gathered together or partially crumpled so that cap 20 can still be stretched to place it on the baby's head.

The blanket and cap are preferably made of inexpensive materials so that they are disposable after use, and fresh ones can be used without the need for the expense of laundering. The blanket fabric 4 can be of woven or non-woven fabric. For example, non-woven fabric is appropriate and inexpensive and can, for example, be one-ply fabric or multi-ply fabric made of rayon, cotton, nylon or other fibers. The fabric should provide a firm outer layer for the thermally insulating blanket. The thermally insulating material having at least one reflecting surface, used in both the blanket and cap, is preferably a reflecting foil such as a flexible plastic metallized foil, for example, "MYLAR" foil, with at least one reflecting surface to be placed towards the body of the baby, to reflect heat escaping from the body back towards the baby The lining fabric 10 can also be of non-woven fabric, or of woven fabric, and preferably is of light weight material so that heat escaping from the body which is reflected back by the foil can readily pass back through the lining towards the body. The reflecting foil and liner preferably cover that part of the blanket which is adjacent to the body of the baby, and may cover a larger part or the whole of the inside of the blanket.

The cap 20 is preferably made of stretchable knitted fabric so that it can readily be placed snugly on the infant's head. The thermally insulating material 28 inserted between the layers of the cap is suitably the same foil as is used to line the blanket, and is placed with a reflecting surface towards the inner layer of the cap so that heat escaping from the baby's head is reflected back towards the baby, and is not lost.

These garments are appropriate for use on a newborn infant immediately following birth and for at least the duration of the hospital stay, or longer. Following delivery the baby is firmly swaddled in the thermally insulated blanket which is secured with the adhesive strips around the baby's body, and the thermally insulated cap is placed on the baby's head, thus allowing heat escaping from the baby's body and head to be retained and reflected back to keep the baby warm. The outfit is particularly appropriately used for the protection of premature babies and other babies having a low birth weight who are especially susceptible to danger if loss of body heat occurs.

I claim:

1. An outfit of thermally insulated clothing for maintaining body temperature in an infant comprising a multi-layer thermally insulated wrap-around blanket wherein said blanket comprises (a) as an outer layer, placed away from the body of the infant, a sheet of cloth fabric having an inner side and an outer side;

(b) as a middle layer, a layer of thermally insulating reflecting foil material having at least one reflecting surface, secured to the inner side of the sheet of cloth fabric said at least one reflecting surface for facing towards the body of the infant and away from the inner side of the sheet of cloth fabric;

(c) as an inner layer, placed adjacent to the body of the infant, a layer of cloth lining material secured to said outer layer and said middle layer, coextensive with and covering the at least one reflecting surface of said layer of reflecting foil material;

(d) means for securing together said outer layer, said middle layer and said inner layer to form the multi-layer blanket; and (e) two strips of adhesive fabric tape secured to the outer side of the sheet of fabric which comprises the outer layer of the blanket.

2. An outfit of thermally insulated clothing of claim 1 further comprising a cap wherein said cap comprises (a) a multi-layer tube of stretchable knitted cloth fabric, secured at one end, having an inside layer for placing adjacent the infant's head, and an outside layer for placing away from the infant's head; and (b) a layer of thermally insulating reflecting foil material, having at least one reflecting surface, inserted between said inside layer and said outside layer of the tube of stretchable knitted cloth fabric, said at least one reflecting surface facing towards the infant's head, adjacent the inside layer of the cap.

3. The outfit of claim 1 wherein the means for securing together the outside layer, the middle layer and the inner layer comprises stitching means.

4. The outfit of claim 1 wherein the outer layer is a sheet of non-woven cloth fabric.

* * * * *